US005709410A

United States Patent [19]

Reeves, Jr.

[11] Patent Number: 5,709,410

[45] Date of Patent: Jan. 20, 1998

[54] DEVELOPMENT AND CONSTRUCTION JOB SCHEDULING METHOD

[76] Inventor: Joe F. Reeves, Jr., 1730 Urbana Ave., Deltona, Fla. 32725

[21] Appl. No.: 707,763

[22] Filed: Sep. 4, 1996

[51] Int. Cl.[6] ..... B42D 15/00

[52] U.S. Cl. ..... 283/67; 283/65; 283/115

[58] Field of Search ..... 283/67, 70, 72, 283/65, 115, 117; 434/154

[56] References Cited

U.S. PATENT DOCUMENTS

| | | | |
|---|---|---|---|
| 1,350,955 | 8/1920 | Bickley . | |
| 2,230,927 | 2/1941 | Bowman et al. | 283/65 X |
| 3,269,753 | 8/1966 | Rham et al. | 283/65 |
| 4,245,401 | 1/1981 | Riehle | 283/115 X |
| 4,483,680 | 11/1984 | Daly | 434/154 |
| 4,559,705 | 12/1985 | Hodge et al. | 33/1 B |
| 5,011,191 | 4/1991 | Gannon et al. | 283/115 |
| 5,431,450 | 7/1995 | Coleman | 283/62 |
| 5,447,336 | 9/1995 | Deighton | 283/115 |
| 5,607,186 | 3/1997 | Schoeder et al. | 283/65 |

*Primary Examiner*—Willmon Fridie, Jr.

*Attorney, Agent, or Firm*—William M. Hobby, III

[57] ABSTRACT

A development project scheduling method for scheduling a plurality of development tasks includes the steps of selecting a construction job schedule chart having a list of a plurality of discrete development tasks for completion of a construction job. The development tasks are listed in the order that each task is to be performed relative to the other tasks. The development project schedule has a bar chart bar for each listed construction task scaled to the days required to complete the task. A calendar overlay is then made having calendar days thereon and a plurality of lines marking the calendar days and scaled to the selected development project schedule job schedule chart development task bar chart bars. The calendar overlay is made having selected calendar days, such as Sundays and holidays, missing therefrom. Overlaying the calendar overlay onto the selected development project schedule chart and aligning the calendar overlay calendar date plurality of lines over the current development task days and chart bars indicates the calendar days that each development task is to be performed and completed and the completion date of the construction job. Adjusting the overlay for lost days due to weather or the like gives a new indication of the calendar days for each construction task and completion date of the development project.

9 Claims, 4 Drawing Sheets

DEVELOPMENT AND CONSTRUCTION JOB SCHEDULING METHOD

BACKGROUND OF THE INVENTION

The present invention relates to development and construction projects scheduling method and especially to a scheduling method for scheduling a plurality of construction tasks which provides the exact calendar days when tasks are to be performed and completed and the completion date for the entire construction job.

In the past, it has been common in development projects to make-up a list of development tasks to be performed for the entire development project and to determine the number of days and the order in which each development project has to be completed. These construction tasks, including overall areas of land design plans, permits, financing, etc., can be performed by a development company's or contractor's own crew or, alternatively, by sub-contractors which have subcontracted for a specific task, such as required in forming a slab edge or the rough plumbing, or rough electrical, obtaining inspector's approvals which tasks would be performed prior to pouring a building slab. The ordering of the trusses might be done at an early stage of the construction job with the delivery of the trusses and lumber package scheduled for a day and time to start the framing of a building.

Prior charts have been made which used various types of bar charts and bars which might indicate the number of days to perform each task. The bars on the charts sometimes overlap and give an indication of the total number of days required for the development project. These charts have had limitations in that a new chart is required every time there are delays in anyone of the selected tasks to be performed as a result of weather or having the subcontractors available at the proper time for the contract. In addition, the number of days in such charts does not take notice that some days, such as Sundays and holidays are not working days.

The present method resolves the prior problems of aligning the scheduling of exact calendar days down to the specific day of the month that each job or task is to be started and completed and takes into account non-working days and is readily adjustable for delays from acts of God to give the schedule completion job for the development project.

Prior art charting apparatus and methods can be seen in the prior art U.S. Pat. No. 4,483,680, to Daly, for a genealogical information recording and arrangement method and apparatus for recording and displaying genealogical and pedigree information on humans or animals. The data on individuals is recorded on a plurality of interconnectable discrete patterns imprinted on transparent self-adhesive material. The Deighton patent, U.S. Pat. No. 5,447,336, is a road pavement management instrument which includes a set of forms for management of road conditions which consist of a road inventory form and a construction form including locations, features, and pavement conditions. In the Coleman patent, U.S. Pat. No. 5,431,450, a medication board is provided which has a board listing of medications, dosages and times medications are to be taken and allows the board to be marked with a marker. The Gannon et al. patent, U.S. Pat. No. 5,011,911, is a view-through information converter for use with preprinted information listings, such as a television programming guide listings chart, and has a transparent plastic sheet superimposed onto the listings chart such that all listings presented on the television listing chart are viewable through the plastic sheet and converts television station numbers and call letters on the listing chart into numbers which are directly usable by the reader to identify television tuner locations.

The Hodge et al. patent, U.S. Pat. No. 4,559,705, is an indexing overlay for video display device and can be overlaid on a computer CRT or plasma digital displayer screen and is made of a high-static vinyl or acetate having columns and rows of discrete displayable positions. In the Bickley patent, U.S. Pat. No. 1,350,955, a production and material control system uses a chart in connection with a system for the control of production and materials in a factory in connection with a system with a control of production and materials in a factory and has a chart line designated for materials received and a second line designated for materials removed and a third line designated for orders received with indications of the length of progress for each designated operation.

In contrast to these prior patents, the present invention is directed towards development project scheduling and in the control of an overall development project by maintaining a plurality of construction job tasks or subcontracts on schedule for particular calendar days and for indicating the completion schedule for the entire development project.

SUMMARY OF THE INVENTION

A development and construction project scheduling method for scheduling a plurality of development and construction tasks includes the steps of selecting a development and construction job schedule chart having a list of a plurality of discrete development and construction tasks for completion of a development project. The development and construction tasks are listed in the order that each task is to be performed relative to the other tasks. The development project schedule has a bar chart bar for each listed construction task scaled to the days required to complete the task. A calendar overlay is then made having calendar days thereon and a plurality of lines marking the calendar days and scaled to the selected construction and development schedule job schedule chart construction task bar chart bars. The calendar overlay is made having selected calendar days, such as Sundays and holidays, missing therefrom. Overlaying the calendar overlay onto the selected development schedule chart and aligning the calendar overlay calendar date plurality of lines over the current construction task days and chart bars indicates the calendar days that each development and construction task is to be performed and completed and the completion date of the construction job. Adjusting the overlay for lost days due to weather or the like gives a new indication of the calendar days for each construction task and completion date of the construction job. Transversely, the solid calendar can be used with transparent schedules overlayed, with same results at the option of the individual user.

BRIEF DESCRIPTION OF THE DRAWINGS

Other objects, features, and advantages of the present invention will be apparent from the written description and the drawings in which.

DESCRIPTION OF THE PREFERRED EMBODIMENT

Figure 1:
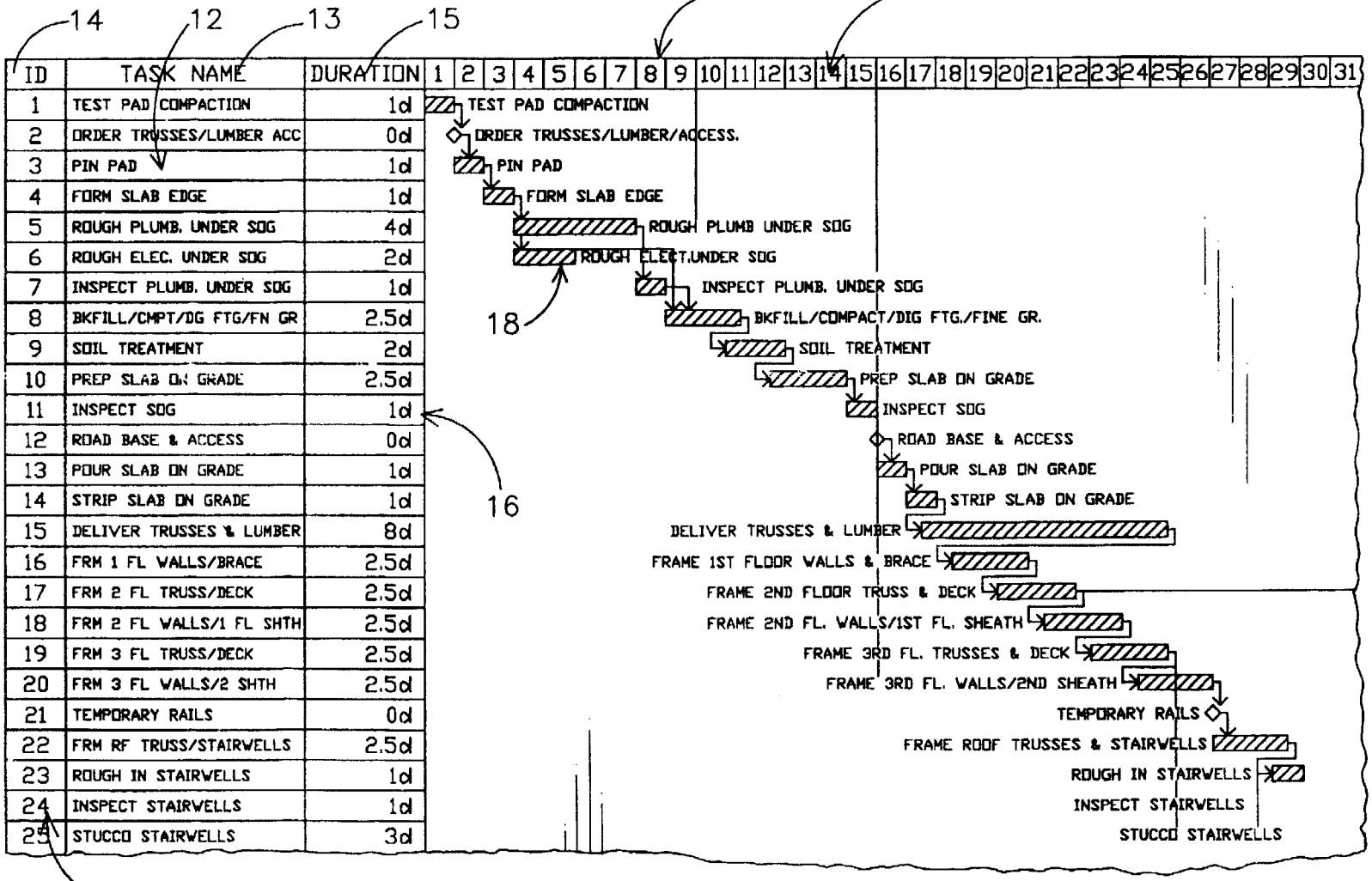
FIG. 1 is a development project schedule chart used in the present method.

Referring to FIG. 1 of the drawings, a construction job schedule chart 10 is illustrated having a numerical ID list 11 adjacent a construction job task 12 listed under a heading task name 13. Each task 12 is one of the task to be performed for a development project and might be performed by a subcontractor or a construction company's own crew. The task includes such things as soil treatment, preparation of the slab on grade, rough in-plumbing, and electrical which tasks are done prior to pouring the slab and obtaining the inspection of the plumbing and electrical. Other tasks, such as ordering the trusses and lumber, delivery date for the trusses and lumber are placed in order through the completion of the development project. The headings for the chart 10 included the ID 14 adjacent the task name 13 and a duration heading 15 list gives a duration list 16 for each task 12 telling the number of days or partial days required to complete each task.

A typical development and construction schedule and chart 10 might have a numerical listing of days done to a scale that works with the bars 18 of the bar chart bars for each task 12. Thus, extending out from the rough electrical, as shown in FIG. 1, has listed two days and a two days length bar on the bar chart which, as indicated, would overlap the forming of the slab edge and would align with certain days in the numerical order 17. When the chart 10 is followed through the bars 18 to the end of the chart, the listing of days 17 for the final completion of the last bar would indicate the number of working days required for the entire development project, subject to any delays that might be experienced during the construction job.

Figure 2:
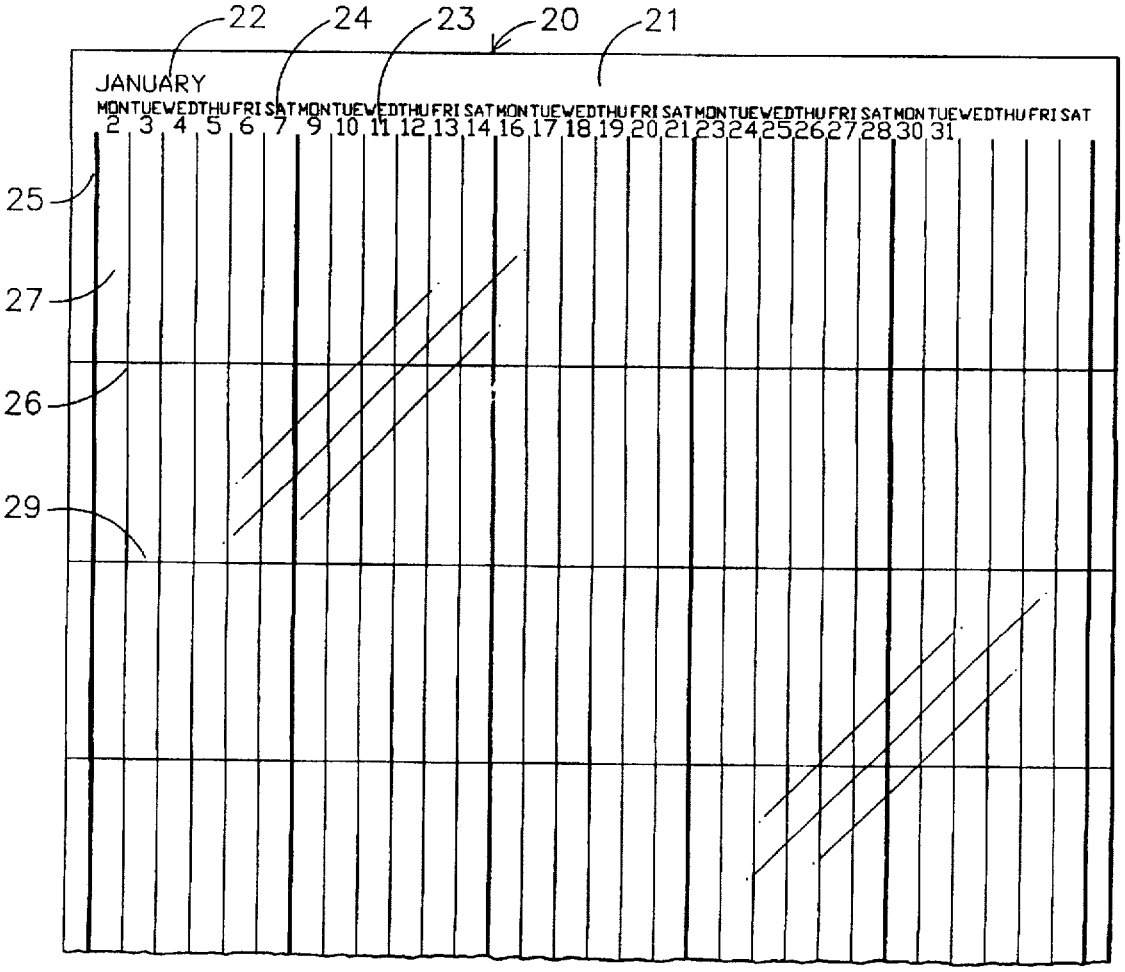
FIG. 2 is a transparent calendar overlay used in the present method.

Referring to FIG. 2, a calendar overlay 20 is illustrated as a transparent overlay but may also be solid or translucent as desired, and may be made of a transparent polymer material 21 having the month 22 thereon and a listing of the days of the month 23 listed across the top of the chart along with the days of the week 24 as to each calendar date 23. As seen in FIG. 2, there is no date for any Sunday or any day in which development project or construction crews would not normally work. Most development project crews do not work on Sundays and holidays which are left off of the overlay 20. Each week in the calendar overlay 20 is divided by a pair of thicker or darker vertically extending lines 25 while each day is divided by a thinner day line 26. The spacing 26 between pairs of lines 26 indicates a days time is made to the same scale as the date 17 in FIG. 1 and also matches the scale of the days on the bars 18 of the bar chart portion of the construction schedule 10. A light horizontal line 29 can be used to aid in squaring the calendar with the schedules for more accuracy and better presentation quality. Single or sets of calendar overlays 20 can be provided for each month of the year. In addition, the scheduling chart 10 can have the bars 18 of the bar chart portion color coded for different buildings or groups of construction tasks.

Figure 3:
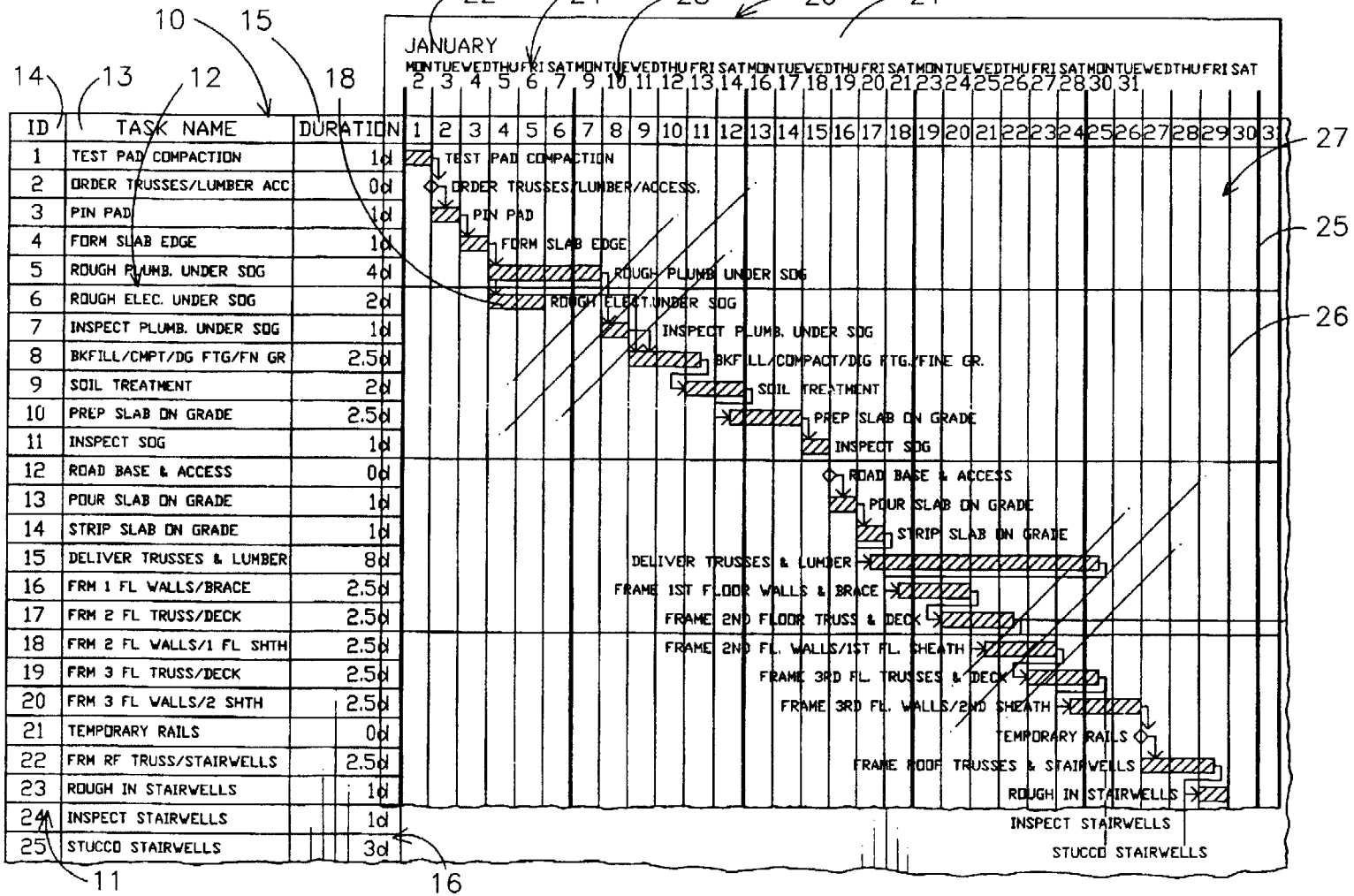
FIG. 3 is the combined development project schedule chart and overlay being used in accordance with the present method.

Turning to FIG. 3, the development project schedule chart 10 has the overlay 20 placed thereover such that Monday of January 22 is placed over day one of the construction job and all of the calendar days of the overlay 20 align with the construction job schedule chart numerical days 17. Since the chart 20 has the Sundays removed and has holidays removed, the calendar chart overlay 20 indicates the exact calendar days which each task in the task list 12 is to be performed and when it is to be completed. In addition, if each of the monthly overlays is laid over the entire development project schedule chart 10, the final date of completion of the entire construction job can be determined from the calendar overlay 20. The overlays 20 can be attached in any way desired, such as with an encapsulated adhesive, such as produced by the 3M Company as POST-IT removable adhesive so that the overlays can be consistently changed and held to the construction schedule charts 10 while the charts are attached to the wall. This also allows for the easy movement of the overlays 20 in the event of a delay of a construction job due to acts of God or weather or hurricanes or the like.

Figure 4:
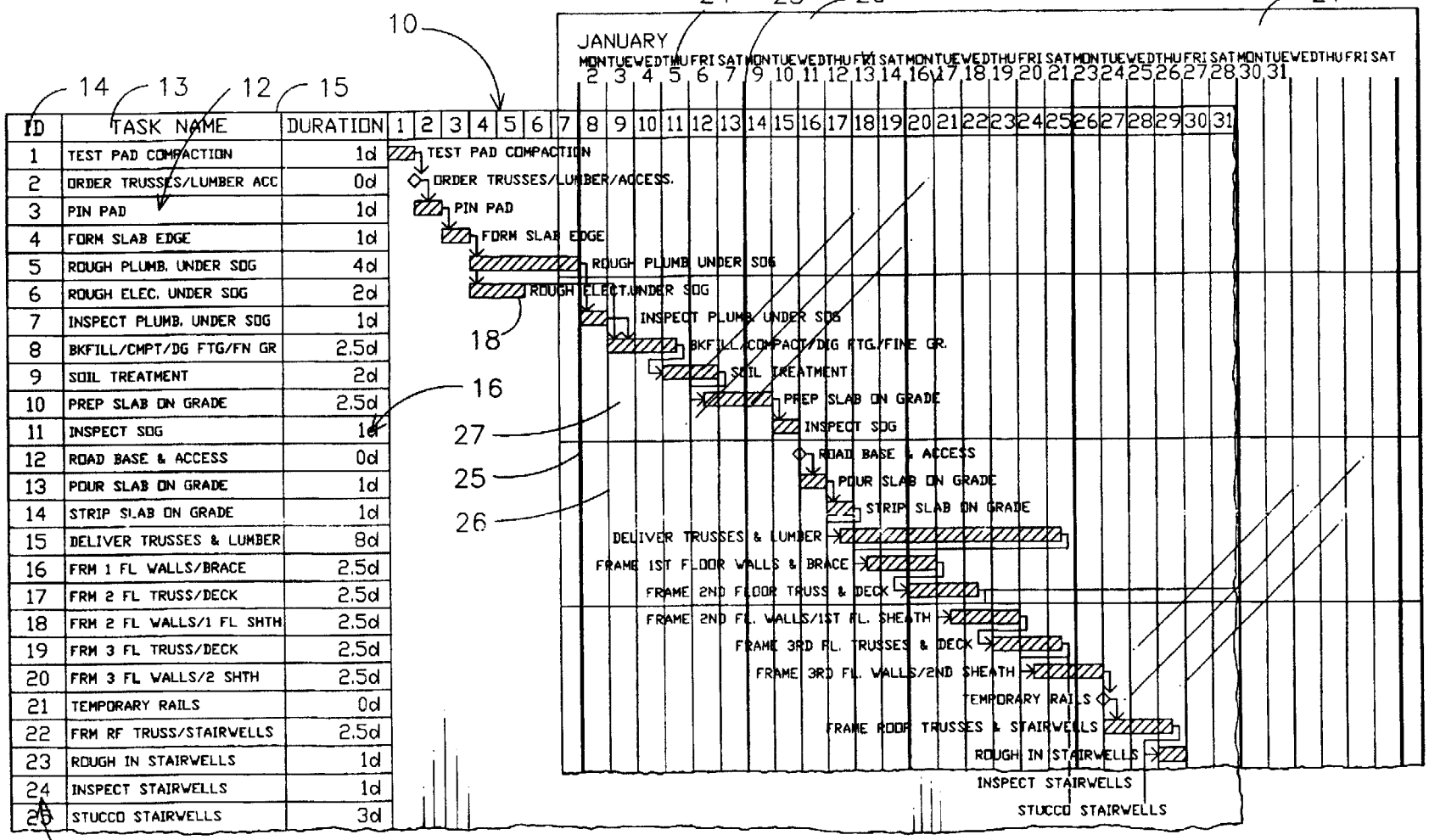
FIG. 4 is the development project chart and overlay in accordance with FIG. 3 realigned to a different position.

As shown in FIG. 4, the overlay 20 has been moved on the construction job schedule chart 10 to align Monday, January 2 with the 8th numerical day on the construction job. This may be because the first working day in January, which was Monday, January 2, may have started the January overlay on the eighth day, upon the completion of the December overlay which went through the 7th day of the job. Alternatively, the chart can be moved because there were delays that forced the January overlay 20 to begin at a later date. Thus, pushing all of the calendar days to the right over the numerical lists of days 17 of the chart 10. This movement of the overlay 20 instantly tells each of the construction crews or subcontractors the exact days from the bar chart bars 18 that they are to start their portion of the work and to complete their work for the particular task 12. It also allows the contractor to look to the end of the chart 10 and to see the final completion date for the entire construction job after any delays. The bar chart bars 18 as well as other components of the construction schedule chart 10 and the overlay 20 can be color coded to better distinguish between components and to define those which might be more important or part of a critical path chart.

The process of a development project scheduling method for scheduling a plurality of development tasks includes selecting a development job schedule chart 10 having a list of a plurality of discrete development or construction tasks 12 for completion of a development or construction job. The development tasks 12 are listed in order of each task that is to be performed relative to the other task while the chart 10 includes a bar chart portion bars 18 for each task listed in the development task 12 scaled to the number of days required to complete the task. An overlay 20 may be made or constructed on a transparent plastic material having the month 22 thereon along with a listing of calendar days 23 and 24 along one side portion and having a plurality of lines 25 and 26 extending vertically from the days and scaled to the selected construction schedule job schedule chart 10 construction task bar chart bars 18. Calendar overlay 20 is produced without the selected calendar days, such as non-working days including Sundays and preselected holidays removed therefrom. Only calendar working days are shown within the overlay 20. The method includes overlaying the calendar overlay 20 onto the selected construction job schedule chart 10 and aligning the calendar overlay calendar day plurality of lines 25 and 26 over the current construction task days 17 and chart bars 18 to indicate the calendar days 23 that each construction task 12 is to be performed and completed and a completion date of the entire construction job. The method includes the moving of the overlay 20 onto the chart 10 to thereby indicate new calendar days for each task and construction job completion and also for the completion of the entire construction job and includes the step of removable attaching the overlay 20 over the scheduling chart 10.

It should be clear at this time that a development project scheduling method for scheduling a plurality of development task and subcontracts has been provided which instantly gives calendar dates to each of the tasks to be performed and starting and completion work days for each of the tasks as well as an instant reading on the completion date for a contract. The present invention can also be used in other areas of project planning including computer programming and in writing, installing and training projects and product development and the like without departing from the spirit and scope of the invention. However, the present invention should not be construed as limited to the forms shown which are to be considered illustrative rather than restrictive.

I claim:

1. A development project scheduling method for scheduling a plurality of development tasks comprising the steps of:

selecting a development project schedule chart having a list of a plurality of discrete development project tasks for completion of the development project, said development project tasks being listed in the order that each task is to be performed relative to the other tasks and said development project schedule having a bar chart bar for each listed development project task scaled to the days required to complete each task;

making a calendar overlay having calendar days along one side portion thereof and a plurality of lines thereon marking calendar days and scaled to the selected development project schedule job schedule chart development task bar chart bars, said calendar overlay having selected calendar days missing therefrom;

overlaying said calendar overlay onto said selected development project schedule chart and aligning said calendar overlay calendar day plurality of lines over the current development task days and chart bars to thereby indicate the calendar days that each development project task is to be performed and completed and the completion date of the development project.

2. A development project scheduling method for scheduling a plurality of development tasks in accordance with claim 1 in which the step of making an overlay includes making a transparent overlay on a transparent polymer sheet.

3. A development project scheduling method for scheduling a plurality of development tasks in accordance with claim 2 in which the step of making an overlay includes making an overlay having the calendar days and calendar month across the top of the overlay and the vertical lines extending therefrom with each two lines forming a calendar day on the schedule chart task bars.

4. A development project scheduling method for scheduling a plurality of development tasks in accordance with claim 3 in which the step of selecting a development project schedule chart includes selecting a development project schedule having a tasks list and a list of the days required to complete each task adjacent thereto.

5. A development project scheduling method for scheduling a plurality of constructing tasks in accordance with claim 4 in which the step of selecting a construction schedule chart includes selecting a schedule chart having the task listed adjacent the bar for the task.

6. A development project scheduling method for scheduling a plurality of development tasks in accordance with claim 5 includes the step of moving the calendar overlay to adjust for the lost or gained days to thereby indicate new calendar days for each task and for the development project completion.

7. A development project scheduling method for scheduling a plurality of development tasks in accordance with claim 6 in which the step of making a calendar overlay includes an overlay without Sundays and preselected holidays to thereby indicate work days for completion by calendar date.

8. A development project scheduling method for scheduling a plurality of development tasks in accordance with claim 7 including the step of removably attaching said overlay over said selected construction job schedule chart.

9. A development project scheduling method for scheduling a plurality of development tasks comprising the steps of:

selecting a transparent development project schedule chart overlay having a list of a plurality of discrete development project tasks for completion of the development project, said development project tasks being listed in the order that each task is to be performed relative to the other tasks and said development project schedule chart overlay having a bar chart bar for each listed development project task scaled to the days required to complete each task;

selecting a calendar having calendar days along one side portion thereof and a plurality of lines thereon marking calendar days and scaled to the selected development project schedule job schedule chart development task bar chart bars, said calendar overlay having selected calendar days missing therefrom;

overlaying said selected development project schedule chart overlay onto said selected development project calendar and aligning said chart overlay current development task days and chart bars over said calendar day plurality of lines to thereby indicate the calendar days that each development project task is to be performed and completed and the completion date of the development project.

* * * * *